US008840427B2

(12) United States Patent
Ku et al.

(10) Patent No.: US 8,840,427 B2
(45) Date of Patent: Sep. 23, 2014

(54) SOCKET WITH AN ASSEMBLING AND UNLOADING MECHANISM

(71) Applicant: YFC-Boneagle Electric Co., Ltd., Taoyuan (TW)

(72) Inventors: Ying-Ming Ku, Taoyuan (TW); Chun-Chieh Chen, Taoyuan (TW)

(73) Assignee: YFC-Boneagle Electric Co., Ltd., Taoyuan (TW)

( * ) Notice: Subject to any disclaimer, the term of this patent is extended or adjusted under 35 U.S.C. 154(b) by 101 days.

(21) Appl. No.: 13/731,031

(22) Filed: Dec. 30, 2012

(65) Prior Publication Data

US 2014/0187084 A1 Jul. 3, 2014

(51) Int. Cl.
*H01R 13/73* (2006.01)

(52) U.S. Cl.
USPC ..... 439/552; 439/557

(58) Field of Classification Search
USPC ..... 439/552–554, 536, 557
See application file for complete search history.

(56) References Cited

U.S. PATENT DOCUMENTS

| | | | | |
|---|---|---|---|---|
| 5,049,092 | A * | 9/1991 | Takano et al. | 439/540.1 |
| 5,632,648 | A * | 5/1997 | Liu | 439/550 |
| 5,800,208 | A * | 9/1998 | Ishizuka et al. | 439/557 |
| 5,813,880 | A * | 9/1998 | Kodama | 439/364 |
| 8,075,344 | B2 * | 12/2011 | Shih | 439/649 |

* cited by examiner

*Primary Examiner* — Hien Vu
(74) *Attorney, Agent, or Firm* — Chun-Ming Shih; HDLS IPR Services

(57) ABSTRACT

A socket with an assembling and unloading mechanism comprises: a frame, having at least one installing hole; at least one holding member for assembling and unloading the frame and having a plate member and a pair of flexible clamping members disposed on the two sides of the plate member, the plate member has an accepting hole, each of the flexible clamping members has a pressing portion and a hook disposed on the one side of the pressing portion and driven by the pressing portion, each hook buckles the peripheral of the frame adjacent to the installing hole; and at least one connecting port, connecting to the inside of the accepting hole; wherein the hook is unloaded from the frame while pressing the pressing portion, and the holding member is withdrawn from the installing hole.

5 Claims, 7 Drawing Sheets

SOCKET WITH AN ASSEMBLING AND UNLOADING MECHANISM

BACKGROUND OF THE INVENTION

1. Field of the Invention

The present invention generally relates to a socket, more particularly to a socket with an assembling and unloading mechanism.

2. Description of Related Art

Nowadays, port socket is usually set at Netcom electronic device, the Netcom electronic device electrically connects with most electronic products through port socket in order to transmit signals among the electronic products and the Netcom electronic device.

The prior port socket mainly has a frame body and a plurality of ports, the frame has a plurality of the mounting hole, each of the ports are corresponding to each of the mounting hole, and finally the frame is fixed to the Netcom electronic device for electrical connections; thus various electronic products are inserted into the port through male plugs and connected with the ports. So that the Netcom electronic devices connect with various electronic products to transmit and exchange signals through the male plugs and ports.

However, the prior port socket still has the following disadvantages. Such that, a port being damaged or the other port with different specifications being replaced, it must be using a screwdriver to dismantle the frame from the Netcom electronic device, and using hand to remove the port from the frame, and replacing it with a new port a new port with different specifications, and finally using a screwdriver to install the frame at the Netcom electronic device, so the processes of repairing or replacing port are extremely cumbersome and inconvenient, and need more time to dismantle the port from the Netcom electronic device. As it can be seen, such process need to be improved immediately.

SUMMARY OF THE INVENTION

The main object of the present invention provides a socket with an assembling and unloading mechanism, and the socket uses holding members to fix connecting ports on a frame in order to achieve the effects of rapid assembling and unloading.

To approach aforesaid object, the socket with the assembling and unloading mechanism of the present invention comprises a frame, at least one holding member and at least one connecting port; the frame has at least one installing hole; the holding member is able to assembly and unload the frame and has a plate member and a pair of flexible clamping members disposed on the two sides of the plate member, the plate member has an accepting hole, each of the flexible clamping members has a pressing portion and a hook disposed on the one side of the pressing portion and driven by the pressing portion, each hook buckles the peripheral of the frame where is neighbor to the installing hole; the connecting port connects to the inside of the accepting hole; wherein the hook is unloaded from the frame while pressing the pressing portion, and the holding member being withdrawn from the installing hole.

The present invention has following advantages listed below: 1. Via the flexible clamping member of the holding member, the pressing portion of the flexible clamping member can be pressed to loosen up the hook from the frame in order to be convenient that user unloads the holding member from the frame. 2. Through the second hook of the body and the first hooks of the plate member, the second hook is pressed to take off the connecting port from the clamping member for conveniently and rapidly dismantling the connecting port.

DETAILED DESCRIPTION OF THE INVENTION

Other and further features, advantages, and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

Figure 1:
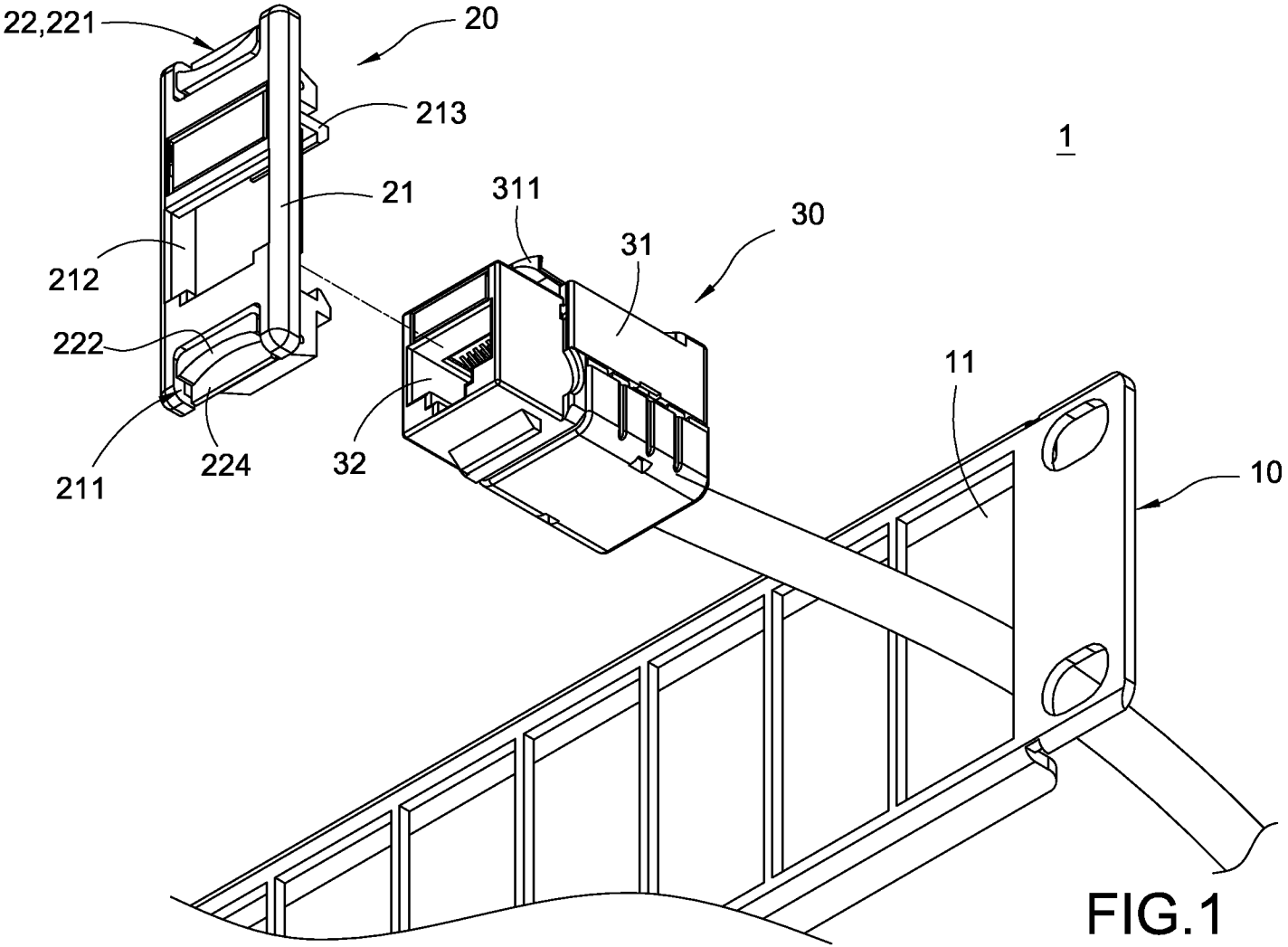
FIG. 1 illustrates a schematic 3-D exploded view of the presentation.
Figure 2:
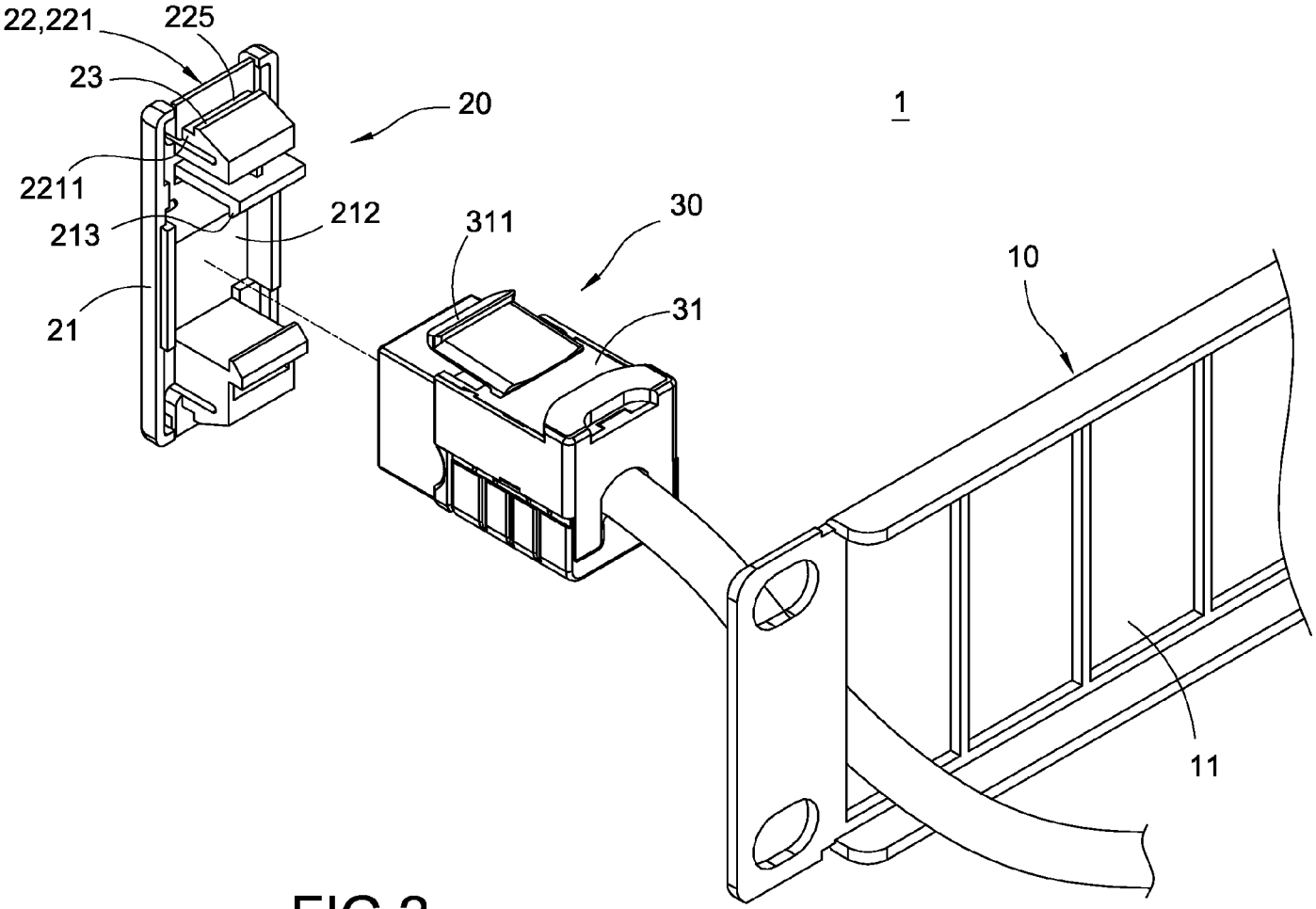
FIG. 2 illustrates a schematic 3-D view of the presentation.

Please refer to FIG. 1 and FIG. 2, which illustrate a schematic 3-D exploded view of the presentation and a schematic 3-D view of the presentation. The present invention provides a socket 1 with an assembling and unloading mechanism mainly has a frame 10, at least one holding member 20 and at least one connecting port 30.

The frame 10 has at least one installing hole 11 and can be made of plastic, the installing hole 11 is rectangular.

The holding member 20 is able to assembly and unload from the installing hole 11 of the frame 10 and has a plate member 21 and a pair of flexible clamping members 22, the plate member 21 is shaped as a long rectangular, each of the two sides of the plate member 21 is shaped as a groove 211, each of the grooves 211 is disposed at the short side of the plate member 21, the grooves 211 are symmetrical to each other, the bottom surface of the groove 211 is elongated and bent toward the frame 10 so as to form a flexible piece 221, shaped as U type, for each of the flexible clamping members 22, the flexible members 22 are symmetrical to each other and clamp to the peripheral of frame 10 where is neighbor to the installing hole 11, the one side of the flexible piece 221 far away from the holding member 20 is a free section 2211, the one side of the free section 2211 is in the internal of the groove 211 and formed as a pressing portion 222, the other side of the free section 2211 is formed as a hook 223 neighbor to the one side of frame 10, the hook 223 penetrates through the installing hole 11 of the frame 10 and clamps the peripheral of the frame 10 neighbor to the installing hole 11, a retaining wall 224 of the flexible piece 221 protrudes and is between the pressing portion 222 and the hook 223, an accommodating slot 225 is between the retaining wall 224 and the hook 223, the peripheral of the frame 10 neighbor to the installing hole 11 embeds in the accommodating slot 225, wherein the hook 223 is unloaded from the frame 10 while pressing the pressing portion 222 of the flexible clamping member 22, the hook 223 of the flexible clamping member 22 is taken off from the peripheral of the frame 10 where is neighbor to the installing hole 11 and the holding member 20 is withdrawn from the frame 10, each of the two inner surfaces of the two sides, neighbor to the accepting holes 212, of the plate member 21 elongates toward the frame 10 to form a first hook 213.

The connecting port 30 assemblies and unloads from the inside of the accepting hole 212 of the holding member 20, the connecting port 30 has a body 31 that is able to assemble and unload the accepting hole 212 and a signal hole 32 disposed at the one side of the body 31, the signal hole 32 is for male sockets, each of the two outer surface of the two sides of the body 31 elongates toward the holding member 20 to form a second hook 311 that is corresponding to the first hook 213.

Figure 3:
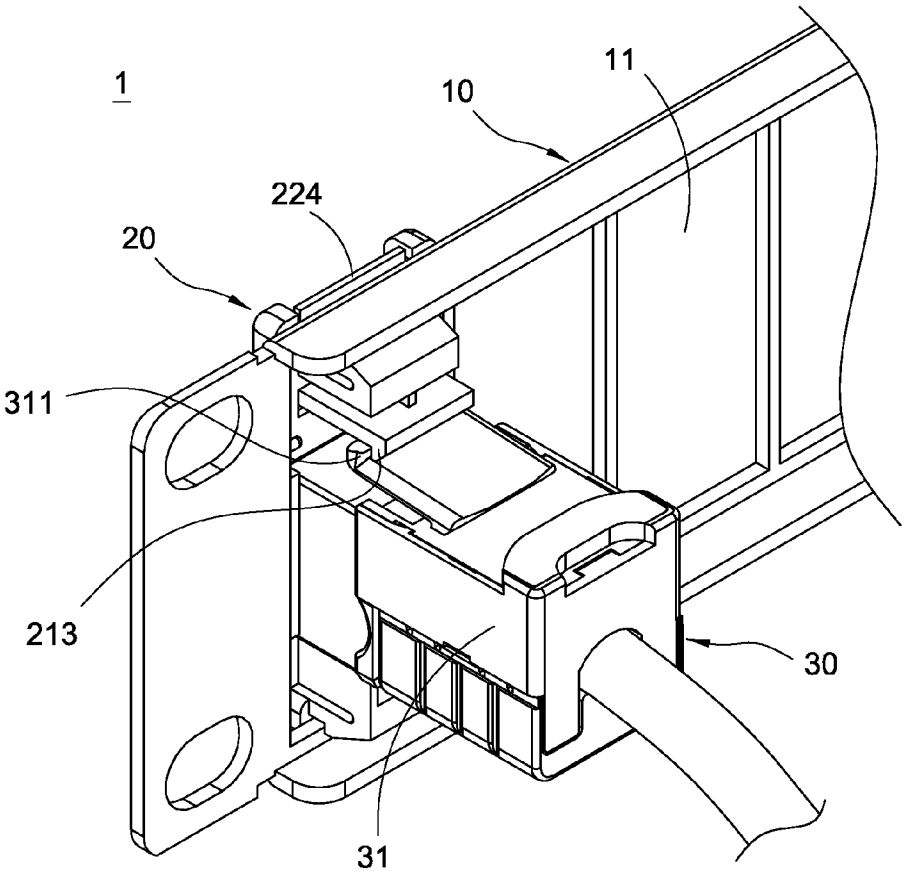
FIG. 3 illustrates a schematic 3-D assembly view of the present invention.
Figure 4:
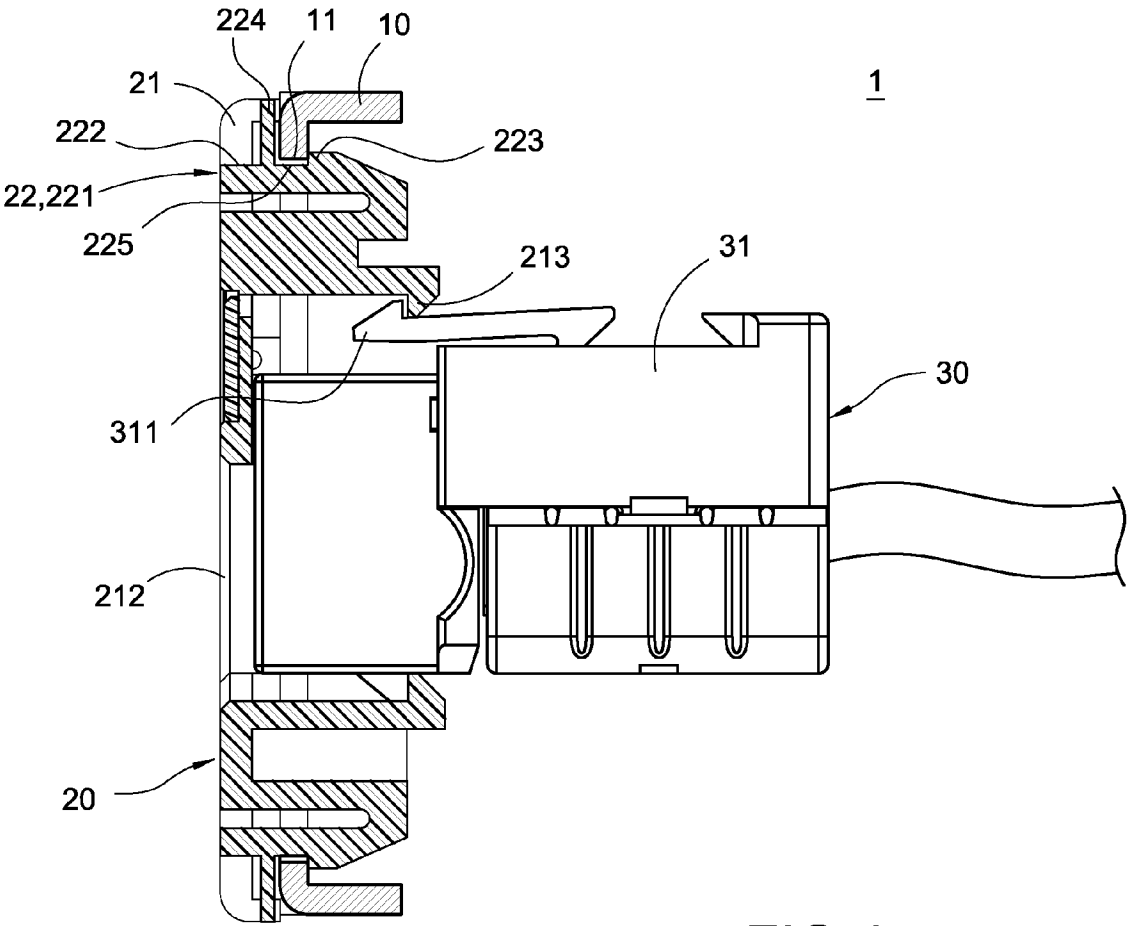
FIG. 4 illustrates a schematic assembly sectional view of the present invention.

Please refer to FIG. 3 and FIG. 4, which illustrate a schematic 3-D assembly view of the present invention and a schematic assembly sectional view of the present invention. First, the body 31 of the connecting port 30 penetrates through the accepting hole 212 of the plate member 20, the second hook 311 of the body 31 clamps the first hook 213 of the plate member 21 for the combination of the body 31 and the plate member 21. Then, the plate member 21 connects to the frame 10 corresponding to the installing holes 11, and the hooks 223 of the flexible clamping members 22 clamp the peripheral of the frame 10 where is neighbor to the installing holes 11 for the combination of the plate member 21 and the frame 10. Therefore, the connecting port 30 is able to firmly fasten to the frame 10 via the holding member 20.

Figure 5:
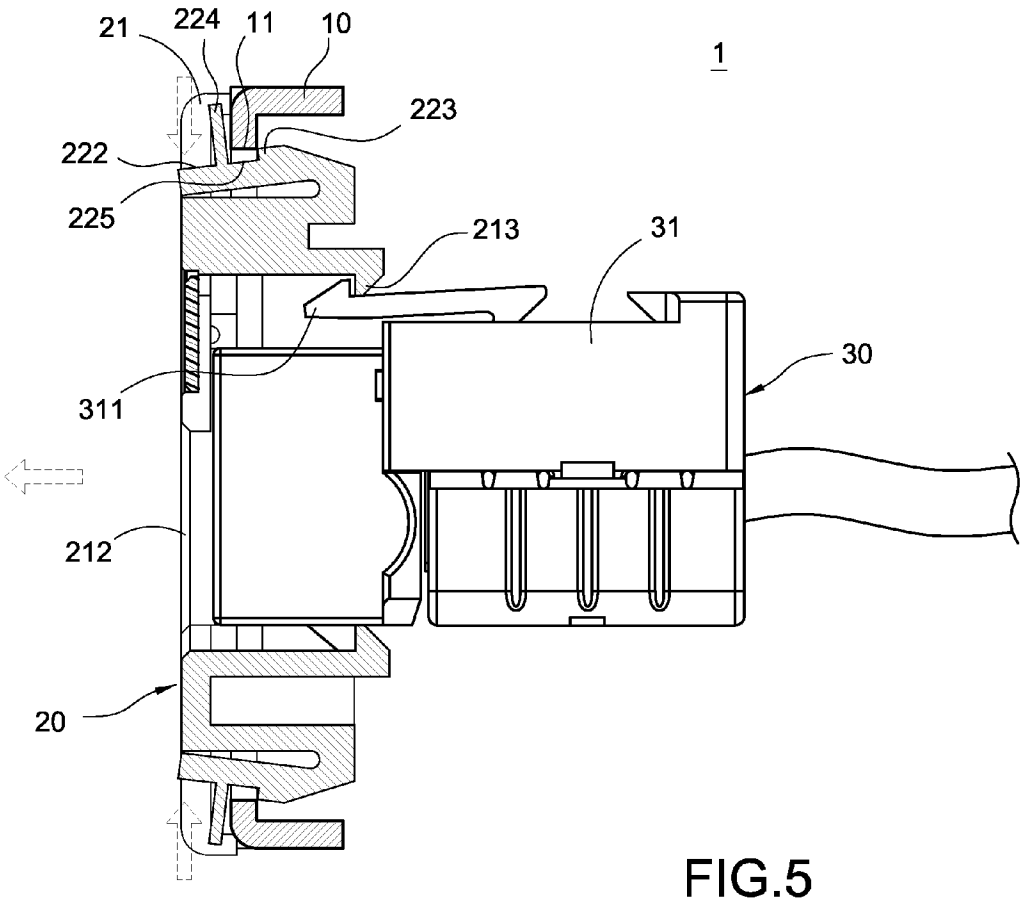
FIG. 5 illustrates a schematic view of an operation state I of the present invention.
Figure 6:
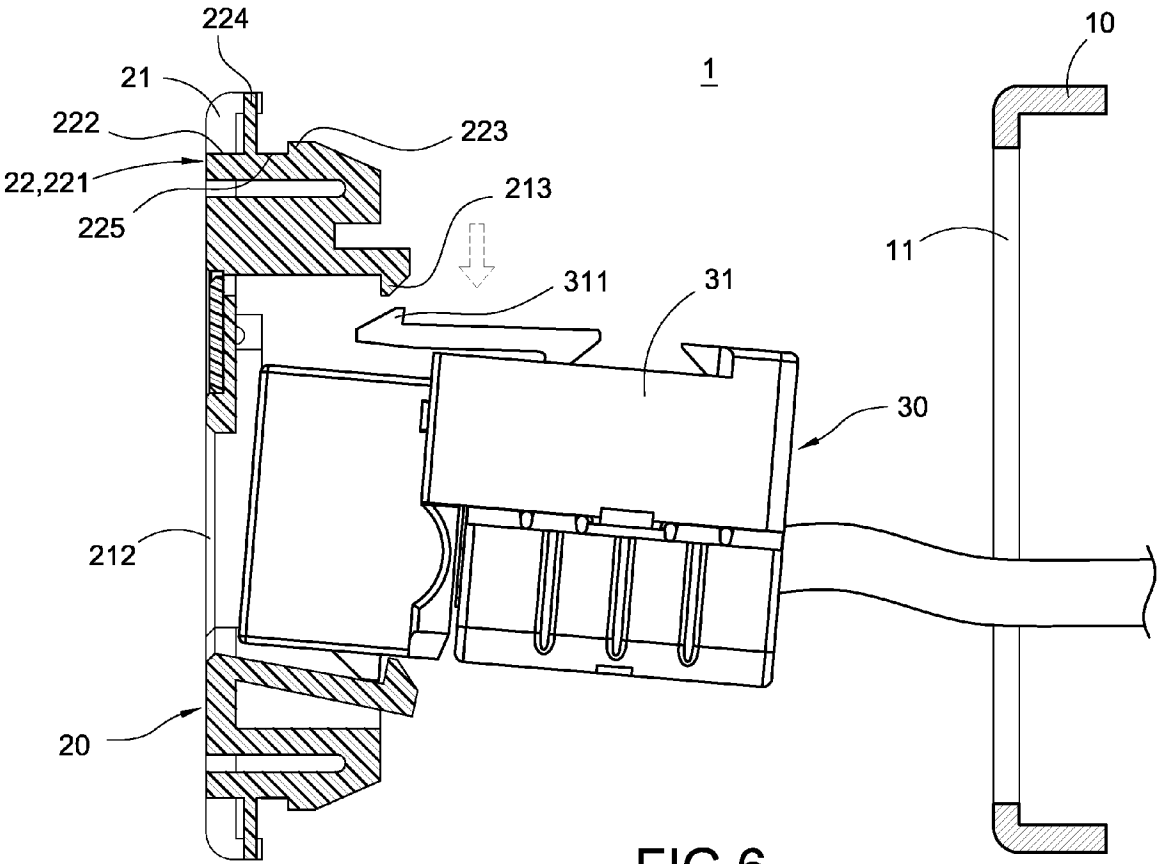
FIG. 6 illustrates a schematic view of an operation state II of the present invention.

Please refer to FIG. 5 and FIG. 6, which illustrate a schematic view of an operation state I of the present invention and a schematic view of an operation state II of the present invention. While the connecting port 30 is damaged and must be unloaded from the frame 10, first the pressing portion 222 of the clamping member 22 is pressed by finger in order to move the hook 223 of the flexible clamping member 22 toward the plate member 21, the hook 223 moves into the installing hole 11 of the frame 10 from the peripheral of the frame 10 where is neighbor to the installing hole 11, the hook 223 is loosen up from the frame 10 so as to take off the holding member 20 from the frame 10. The second hook 311 of the body 31 is pressed again in order to move the second hook 311 toward the body 31, thus the second hook 311 moves into the accepting hole 212 so as to loosen up the second hook 311 from the plate member 21. Hence, the body 31 is unloaded from the plate member 21.

Figure 7:
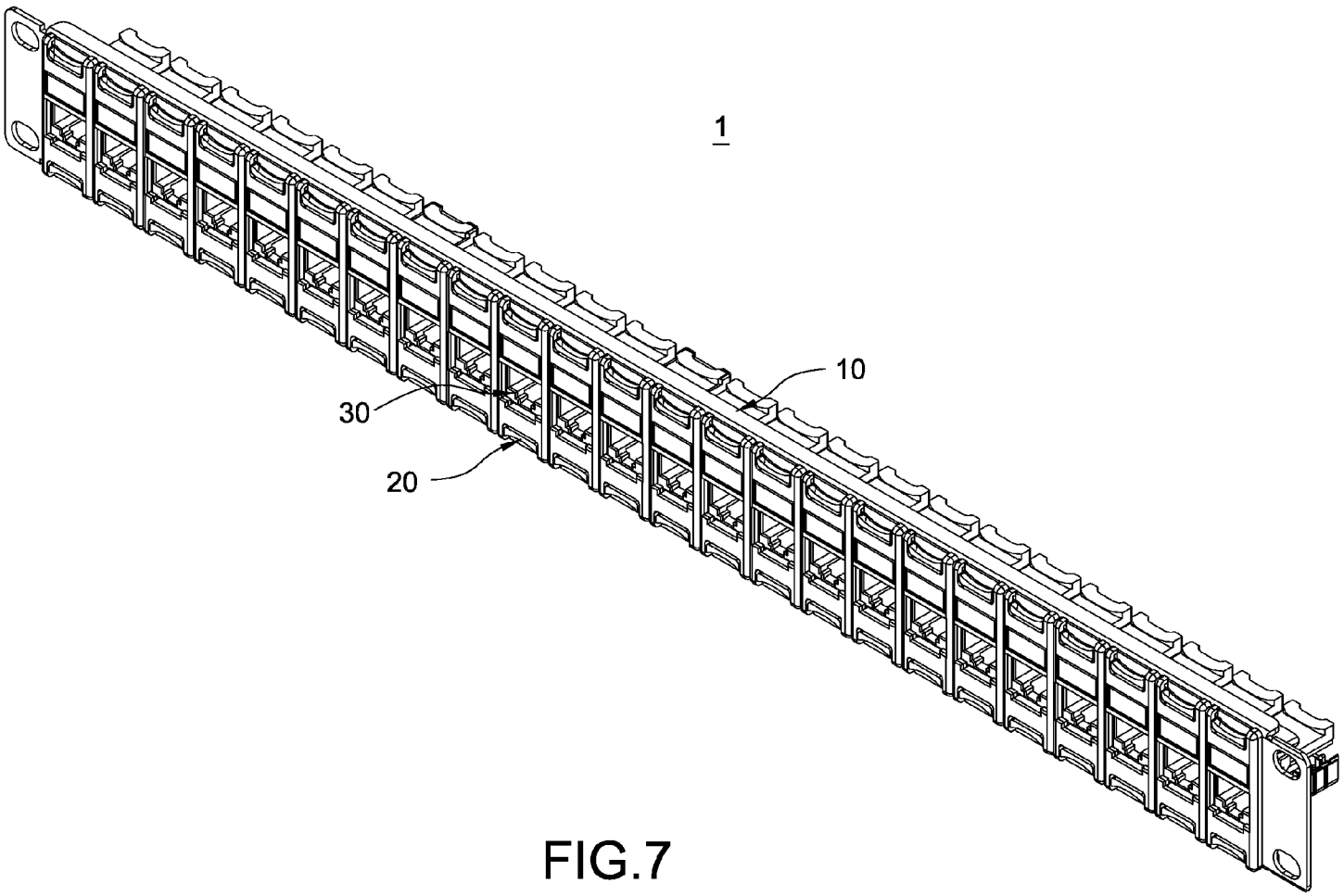
FIG. 7 illustrates a schematic view of the present invention.

Please refer to FIG. 7, which illustrates a schematic view of the present invention. While the numbers of the installing hole 11, the holding member 20 and the connecting port 30 are plural and the one connecting port 30 is damaged, the holding member 20 with the damaged connecting port 30 shall be directly dismantled from the frame 10 for user unloading the damaged connecting port 30 with the holding member 20 and changing a new connecting port 30. Thus the new connecting port 30 is fixed on the frame 10 through the holding member 20, so that the effects to easy unloading and maintenance are achieved. Further, to change the other connecting ports with different specifications can use the same way.

Besides, via the flexible clamping member 22 of the holding member 20, the pressing portion 222 of the flexible clamping member 22 can be pressed to loosen up the hook 223 from the frame 10 in order to be convenient that use unloads the holding member 20 from the frame 10. So that the effects of convenient and rapid dismantling are achieved.

Further, through the second hook 311 of the body 31 and the first hooks 213 of the plate member 21, the second hook 311 of the body 31 is pressed to take off the connecting port 30 from the clamping member 20 for conveniently and rapidly dismantling the connecting port 30. More, by means of the accommodating slot 225 between the retaining wall 224 of the flexible clamping member 22 where the peripheral of the frame 10 neighbor to the installing hole 11 clamps to and the hook 223 of the flexible clamping member 22, the holding member 20 is firmly fixed on the frame 10.

Further more, each of the pair of flexible clamping members 22 is disposed at the one short side of the plate member 21, and the two flexible clamping members 22 are symmetrical to each other, so that only one flexible clamping member 22 being pressed is able to conveniently take off the holding member 20 from the frame 10.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An electrical connector socket (1) with an assembling and unloading mechanism comprising:

a frame (10), having at least one installing hole (11);

at least one holding member (20) for assembling and unloading the frame (10) and having a plate member (21) and a pair of flexible clamping members (22) disposed on the two sides of the plate member (21), the plate member (21) having an accepting hole (212), each of the flexible clamping members (22) having a pressing portion (222) and a hook (223) disposed on the one side of the pressing portion (222) and driven by the pressing portion (222), each hook (223) buckling a peripheral of the frame (10), the peripheral of the frame 10 adjacent to the installing hole (11); and at least one connecting port (30) having a body being secured connected to the inside of the accepting hole (212);

wherein the hook (223) is unloaded from the frame (10) while pressing the pressing portion (222) and the holding member (20) being withdrawn from the installing hole (11), wherein each of the two sides of the plate member (21) is shaped as a groove (211), the bottom surface of the groove (211) being elongated and bent toward the frame (10) so as to form a flexible piece (221) for each of the flexible clamping members (2), wherein the one side of the flexible piece (221) far away from the holding member (20) is a free section (2211), the one side of the free section (2211) being in the internal of the groove (211) and formed as the pressing portion (222), the other side of the free section (2211) being formed as the hook (22), and wherein a retaining wall (224) of the flexible piece (221) protrudes between the pressing portion (222) and the hook (223), an accommodating slot (225) is between the retaining wall (224) and the hook (223), the peripheral of the frame (10) adjacent to the installing hole (11) is embedding in the accommodating slot (225).

2. The socket (1) with an assembling and unloading mechanism according to claim 1, wherein the pair of flexible clamping members (22) are symmetrical to each other.

3. The socket (1) with an assembling and unloading mechanism according to claim 1, wherein the plate member (21) is of long rectangular shape, each of the grooves (211) being disposed at a short side of the plate member (21).

4. The socket (1) with an assembling and unloading mechanism according to claim 1, wherein the connecting port (30) further has a signal hole (32) disposed at the one side of the body (31).

5. The socket 1 with an assembling and unloading mechanism according to claim 1, wherein each of the two inner surfaces of the two sides of the plate member (21) is adjacent to the accepting hole (212) and elongates toward the frame (10) to form a first hook (213), each of two outer surface of the two sides of the body (31) elongates toward the holding member (20) to form a second hook (311) on the body corresponding to the first hook (213).

* * * * *